United States Patent [19]

Holladay et al.

[11] 4,047,727

[45] Sept. 13, 1977

[54] SKATEBOARD ROLLER WHEEL ASSEMBLY

[76] Inventors: Mark Holladay, 29 Sixth Street; Daryl Mattew Hall, 55-10th Court, both of, Hermosa Beach, Calif. 90254

[21] Appl. No.: 724,370

[22] Filed: Sept. 17, 1976

[51] Int. Cl.[2] ..... B62B 3/00

[52] U.S. Cl. ..... 280/87.04 A; 280/11.28; 301/5.7

[58] Field of Search ..... 280/11.28, 11.27, 11.23, 280/11.22, 11.1 BT, 11.1 R, 11.12, 11.19, 87.04 A, 87.04 R; 301/5.3, 5.7

[56] References Cited

U.S. PATENT DOCUMENTS

| | | | |
|---|---|---|---|
| 108,184 | 10/1970 | Pollitt | 280/11.27 |
| 113,062 | 3/1871 | Hovey | 280/11.28 |
| 2,064,690 | 12/1936 | Schavone | 280/11.28 |
| 3,622,172 | 11/1971 | Goodwin | 280/11.22 |
| 3,722,900 | 3/1973 | Dickert | 280/11.1 BT |
| 3,795,409 | 3/1974 | Cudmore | 280/87.04 A |
| 3,995,873 | 12/1976 | Pantzar | 280/11.28 |

*Primary Examiner*—Joseph F. Peters, Jr.
*Assistant Examiner*—David M. Mitchell
*Attorney, Agent, or Firm*—William C. Babcock

[57] ABSTRACT

A pair of roller wheel assemblies that are secured in longitudinally spaced relationship to an elongate platform of a skateboard. Each assembly includes a first centrally disposed resilient roller wheel and a pair of independently rotatable second rollers of generally frusto-conical shape situated on opposite sides of the first roller wheel. When the skateboard is guided in a straight path by a user the major portion of his weight is supported by the first roller wheels, and there is a minimum tendency for the skateboard to slow down in coasting. However, when the platform is tilted transversely by a user to guide the skateboard in a curved path, one of the second rollers is forced into rotatable frictional contact with the supporting surface to prevent the skateboard slipping relative to the latter.

7 Claims, 4 Drawing Figures

SKATEBOARD ROLLER WHEEL ASSEMBLY

BACKGROUND OF THE INVENTION

1. Field of the Invention

Skateboard Roller Wheel Assembly.

2. Description of the Prior Art

In recent years in skateboard design the tendency has been to use resilient roller wheels that have a length substantially greater than their diameter. Such roller wheels provide greater stability in a skateboard, but have the operational disadvantage that they lessen the distance a skateboard will coast due to the sequential deformation of the roller wheels of substantial length as they roll over a supporting surface.

A major object of the present invention is to provide an assembly that has multiple independent rotatable roller wheels that are so arranged that the major weight of the user is supported on centrally disposed roller wheels when the skateboard is traveling in a substantially straight path, but with second frusto-conical roller wheels being forced into rotatable frictional contact with the supporting surface when the skateboard is directed in a curved path. The frictional contact of the second roller wheels with the supporting surface assures that there will be little or no tendency for the skateboard to slide transversely relative to the supporting surface, and tight curves may be negotiated with the skateboard without detracting from the coasting capability of the skateboard.

Another object of the invention is to supply a roller wheel assembly that is attractive in appearance, may be easily mounted on an existing skateboard platform, can be fabricated from standard commercially available materials, and retailed at a sufficiently low price as to encourage the widespread use thereof.

SUMMARY OF THE INVENTION

A hollow frame that supports a centrally disposed transverse shaft. The rearward end of the frame is pivotally supported from the bottom side of a skateboard platform. The forward end of the frame defines an eye that engages a rigid member that depends from the skateboard, and the eye being sandwiched between two resilient pads. When the platform is tilted transversely, portions of the resilient pads are compressed, and the frame tends to tilt transversely with the platform.

The shaft rotatably supports a first centrally disposed cylindrical roller wheel and a pair of generally frusto-conical second roller wheels on opposite sides of the first roller wheel. The first and second roller wheels are independently rotatable. A pair of frames are secured to the bottom surface of the skateboard in longitudinally spaced relationship, and support first and second roller wheels as previously described.

When a user is guiding the skateboard in a straight path the major portion of his weight is supported on the first wheel assemblies, and the skateboard has a maximum coasting capability. Upon the user transversely tilting the platform, the skateboard is directed to pursue a curved path, with a second of the roller wheels of each assembly being forced into rotatable frictional contact with the supporting surface to prevent any lateral slipping of the skateboard relative to the supporting surface.

DESCRIPTION OF THE PREFERRED EMBODIMENT

Figure 1:
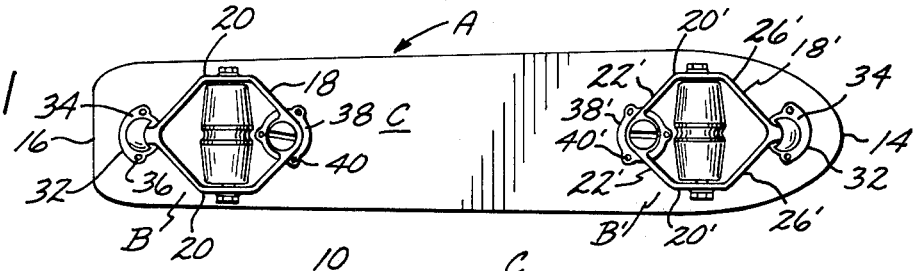
FIG. 1 is a bottom plan view of a skateboard platform with a pair of the roller wheel assemblies secured in longitudinal spaced relationship thereto.

A skateboard A is shown in FIG. 1 that has a pair of identical longitudinally spaced wheel assemblies B and B′ secured to an elongate platform C that forms a part of the skateboard. The platform C includes a top surface 10 and bottom surface 12, with the platform also including a forward end 14 and rearward end 16. Inasmuch as the wheel assemblies B and B′ are of identical structure, only one of the wheel assemblies will be described in detail.

The roller wheel assembly B as may be seen in the drawings, includes a hollow rigid frame 18 that includes a pair of parallel laterally spaced side pieces 20. A pair of first forwardly and inwardly extending legs 22 project from the sidepieces 20, with the first legs at a forward apex thereof developing into an eye 24 that defines an opening **24*a***.

A pair of rearwardly and inwardly extending legs 26 project rearwardly from the pair of side pieces 20, with the second legs at their apex developing into a ball 28. The pair of side pieces 20 at substantially the center thereof have a pair of transversely aligned bores 30 formed therein.

Figure 2:
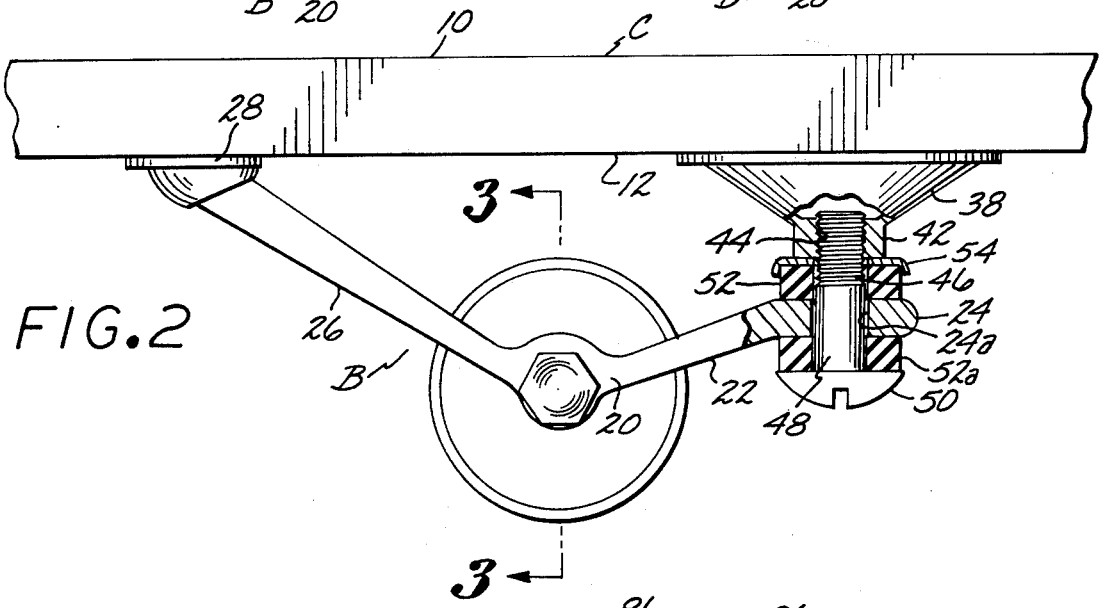
FIG. 2 is a side elevational view of one of the roller wheel assemblies.

A socket defining member 32 is provided that has an outwardly extending flange 34 through which screws 36 extend as may be seen in FIG. 1 to hold the member 32 in a fixed position on the bottom surface 12 of the platform C. In FIGS. 1 and 2 it will be seen that a base member 38 is secured to the bottom surface 12 of platform C by a number of screws 40 or other suitable fastening means, with the base member having a boss 42 that extends downwardly therefrom. A tapped bore 44 extends upwardly in the boss 42 as shown in FIG. 2. The tapped bore 44 is removably engaged by a threaded shank 46 of a screw 48 which screw has an enlarged head 50. The shank 46 has a transverse cross section slightly smaller than that of the opening **24*a*, and through which opening the screw extends. The eye 24 has upper and lower resilient pads of annulus shape in abutting contact with the upper and lower surfaces thereof, and the threaded shank 46 extending upwardly through these pads and the opening 24*a* as shown in FIG. 2. When the screw 48 is tightened, the screw is supported from the base member 38, and the upper and lower resilient pads are forced into pressure contact with upper and lower surfaces of the eye 24. The ball 28 is pivotally supported in the socket defining member 38. The upper resilient pad 52 has a washer 54 mounted thereon and disposed between the upper surface of the pad and the lower surface of the boss 42 as shown in FIG. 2**.

Figure 3:
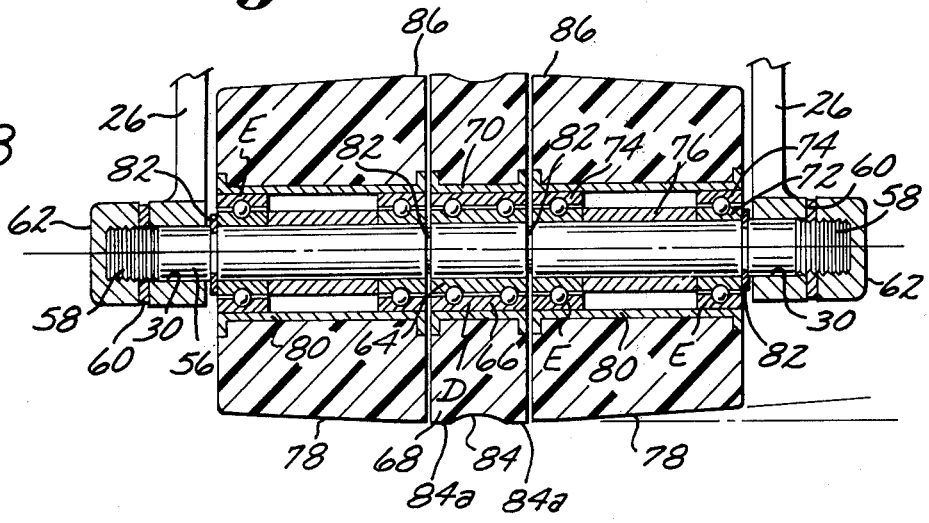
FIG. 3 is a fragmentary cross-sectional view of one of the roller wheel assemblies taken on the line 3—3 of FIG. 2.

A transverse shaft 56 is provided that has oppositely disposed threaded end portions 58, with the shaft being supported in the bores 30, and the shaft of such length that the threaded end portions 58 are outwardly disposed from the frame 18 as illustrated in FIG. 3. Washers 60 are mounted on the threaded end portions 58 of the shaft and are forced into abutting contact with the frame 18, when the threaded portions are engaged by a pair of nuts 62.

A first ball bearing assembly D is provided that occupies a generally central position on the shaft 56, with the ball bearing assembly including an inner race 64 and outer race 66. A first cylindrical roller wheel 68 is provided that is formed from a polymerized resin such as polyurethane, and the roller wheel having a centrally disposed transverse sleeve 70 formed as a part thereof, which sleeve engages the outer race 66 of the first ball bearing assembly D. Two sets E of second ball bearing assemblies are provided, that are mounted on the shaft 56 on opposite sides of the first ball bearing assembly D as is illustrated in FIG. 3. Each of the sets of second ball bearing assemblies includes two ball bearing units, each of which has an inner race 72 and an outer race 74, with the two ball bearing units being separated by a spacer sleeve 76 mounted on the shaft 56 as illustrated in FIG. 3. Two second rollers 78 are provided that are of generally frusto conical shape, and each of the second rollers being provided with a transverse centrally disposed sleeve 80. The sleeve 80 of each second roller wheel 78 engages the outer races 74 of the ball bearing units E as illustrated in FIG. 3. The second roller wheels, like the first roller wheels 68, are formed from a polymerized resilient resin such as polyurethane or the like. The first and second roller wheels 68 and 78 are independently rotatable on the shaft 56, and are maintained out of contact with one another as well as the side pieces 26 by a number of spacing members 82 that encircle the shaft 56 and are situated thereon as illustrated in FIG. 3. A first cylindrical roller wheel 68 preferably has a centrally disposed, circumferentially extending groove 84 formed therein as illustrated in FIG. 3 that subdivides the exterior surface of the first roller wheel into two circumferentially extending surfaces of cylindrical shape that are identified in FIG. 3 by the numeral **84*a* and which serve to support the weight of the user (not shown) when the skateboard A is being directed along a straight path. The second roller wheels 78 adjacent the first wheel 68 preferably are formed with cylindrical surfaces 86 that are of substantially the same width as the surfaces 84*a*.**

Figure 4:
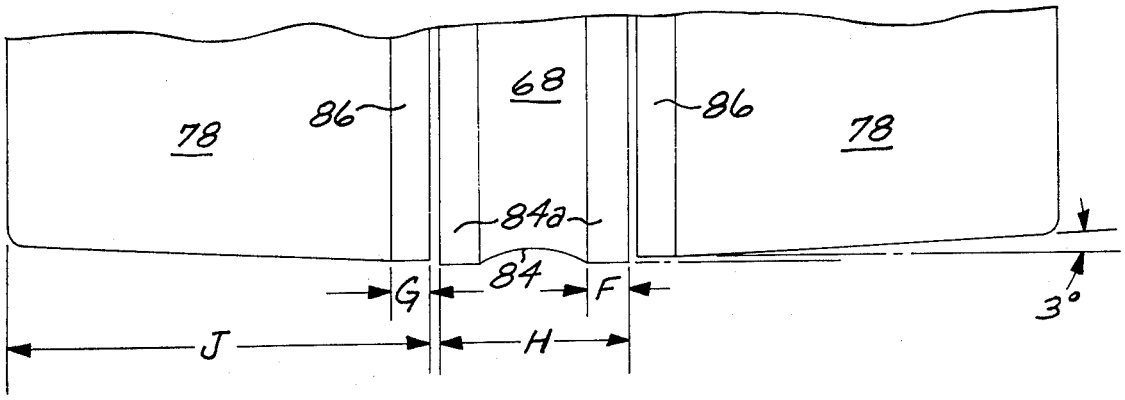
FIG. 4 is a fragmentary front elevational view of a lower portion of one of the roller wheels.

The dimensions of the first roller wheel 68 and second roller wheels 78 may vary, but has been found from experience that satisfactory results are obtained when the width F of the surfaces **84*a* are of substantially the same dimensions as the width G of the surfaces 86. Also, it is desirable that the length J of each second roller wheel 78 be at least twice the length H of the first roller wheel 68 as shown in FIG. 4. The angulation of the exterior surfaces of the second roller wheel 78** may vary, but a three degree taper on the frusto conical surfaces has been found to be quite desirable.

The groove 84 permits the first roller wheel 68 to roll over small pebbles or rock without the rocks or pebbles resulting in the lateral movement of the skateboard A. The diameter of the surfaces **84*a* as shown in FIG. 4 are preferably slightly greater than the cylindrical surfaces 86. When the skateboard is being guided in a straight path by the user (not shown), the weight of the user will be supported primarily on the surfaces 84*a*, with the portions of these surfaces in contact with the supporting surface being sequentially flattened as the skateboard moves over the latter. In prior art skateboards that utilize elongate resilient roller wheels, the length of the roller wheels in contact with the supporting surface deform and flatten, and it is this factor that slows down the coasting of such prior art skateboards. In the present invention, there is a minimum surface that flattens and deforms as the skateboard A moves over the supporting surface, and as a result the coasting of the skateboard A is impaired to a minimum degree. When a user of the skateboard A transversely tilts the platform C, a portion of the upper and lower resilient pads 52 and 52*a* are compressed, and the frame 18 tends to tilt with the platform, and as a result one of the second roller wheels 78 being forced into frictional contact with the supporting surface. The increased frictional resistance offered by this contact of the second roller 78 with the supporting surface assures that there will be little or no tendency for the skateboard A to slide transversely relative to the supporting surface, and as a result an extremely sharp curve may be maneouvered without such lateral slipping taking place. Thus, the user of the skateboard A has all the operational advantages of a skateboard equipped with elongate resilient roller wheels, but without the operational disadvantage that accrues from such roller wheels in slowing down the capability of the skateboard. The diameter of the second cylindrical surfaces 86, if desired, may be sufficiently small relative to the surfaces 84*a*, that the second roller wheels 78** only rotate when the skateboard A is guided in a relatively sharp curved path over a supporting surface (not shown).

The use and operation of the invention has been described previously in detail and need not be repeated.

We claim:

1. In combination with an elongate skateboard that has a platform that has a top surface on which a user stands and a bottom surface, a pair of longitudinally spaced roller wheel assemblies secured to said bottom surface, each of said roller wheel assemblies including:

a. a hollow rigid frame that includes a pair of transversely spaced side pieces that have forward and rearward ends, a pair of first legs that extend forwardly and inwardly from said first ends to develop at their forward extremities into an eye, a pair of second legs that extend rearwardly and inwardly from said second ends to develop at their rearward extremities into a ball, and said side pieces at substantially the centers thereof having transversely aligned bores defined therein;

b. first means secured to said bottom surface that resiliently engage said eye and force said frame to tilt transversely when said platform is tilted transversely by said user in guiding said skateboard in a curved path;

c. second means secured to said bottom surface that pivotally engage said ball;

d. a transverse shaft supported in said bores, said shaft including threaded end portions that project outwardly from said side pieces;

e. a pair of nuts that engage said end portions and removably hold said shaft in a fixed position in said frame;

f. a first ball bearing assembly mounted on substantially the center of said shaft and a pair of second ball bearing assemblies mounted on said shaft on opposite sides of said first ball bearing assembly and independently rotatable relative to the latter;

g. a first generally cylindrical roller wheel formed from a resilient polymerized resin rotatably supported on said shaft by said first ball bearing assembly; and h. a pair of second generally frusto-conical roller wheels formed from a resilient polymerized resin rotatably supported on said shaft by said second ball bearing assemblies, said skateboard when guided in a straight path by said user having the major portion of the weight of said user supported on said first roller wheel and a minimum surface of said roller wheels in contact with a supporting surface on which said skateboard is used but said frame in cooperation with said first means and shaft forcing one of said second roller wheels into additional frictional rotatable contact with said supporting surface when said platform is transversely tilted by said user in guiding said skateboard in a curved path.

2. A roller wheel assembly as defined in claim 1 in which said first roller wheel has a centrally disposed circumferentially spaced groove therein that subdivides the exterior surface of said roller wheel into two laterally spaced cylindrical areas that provide minimum contact with a supporting surface when said first roller wheels are rolling over the latter, and pebbles and small stones on said supporting surface not laterally deflecting said first roller wheels due to said pebbles and small stones being passed over by said grooves.

3. A roller wheel assembly as defined in claim 2 in which said second roller wheels include circumferential extending cylindrical surfaces adjacently disposed to said cylindrical areas of said first roller wheel.

4. A roller wheel assembly as defined in claim 1 which in addition includes:

i. spacer means on said shaft for maintaining said first roller wheel and second roller wheels in desired laterally spaced relationship.

5. A roller wheel assembly as defined in claim 1 in which each of said second roller wheels has a length at least double the length of said first roller wheel.

6. A roller wheel assembly as defined in claim 1 in which each of said second roller wheels has a taper on the frusto-conical portion thereof of substantially three degrees.

7. A roller wheel assembly as defined in claim 1 in which said first and second roller wheels are formed from polyurethane.

* * * * *